US009546448B2

(12) United States Patent
Eerikäinen et al.

(10) Patent No.: US 9,546,448 B2
(45) Date of Patent: Jan. 17, 2017

(54) DOCTOR APPARATUS AND BLADE HOLDER

(71) Applicants: Hannu Eerikäinen, Varkaus (FI); Tommi Luosma, Jyväskylä (FI)

(72) Inventors: Hannu Eerikäinen, Varkaus (FI); Tommi Luosma, Jyväskylä (FI)

(73) Assignee: VASLMET TECHNOLOGIES, INC., Espoo (FI)

( * ) Notice: Subject to any disclaimer, the term of this patent is extended or adjusted under 35 U.S.C. 154(b) by 0 days.

(21) Appl. No.: 14/848,036

(22) Filed: Sep. 8, 2015

(65) Prior Publication Data

US 2016/0070226 A1 Mar. 10, 2016

(30) Foreign Application Priority Data

Sep. 9, 2014 (FI) ..... 20145786

(51) Int. Cl.
*D21G 3/04* (2006.01)
*D21G 3/00* (2006.01)
*B31F 1/14* (2006.01)

(52) U.S. Cl.
CPC ..... *D21G 3/00* (2013.01); *B31F 1/145* (2013.01); *D21G 3/005* (2013.01)

(58) Field of Classification Search
USPC ..... 162/281
IPC ..... D21G 3/04; B31F 1/12
See application file for complete search history.

(56) References Cited

U.S. PATENT DOCUMENTS

| | | | |
|---|---|---|---|
| 2,732,773 | A | 1/1956 | Smith |
| 8,152,966 | B2 | 4/2012 | Eerikäinen et al. |
| 2009/0148208 | A1 | 6/2009 | Gauvin et al. |

FOREIGN PATENT DOCUMENTS

| | | |
|---|---|---|
| FI | 119823 | 3/2009 |
| FI | 20105850 | 9/2011 |
| WO | 2009047385 A1 | 4/2009 |

OTHER PUBLICATIONS

EPO Search Report for FI 20145786 dated Apr. 10, 2015.

*Primary Examiner* — Mark Halpern
(74) *Attorney, Agent, or Firm* — Stiennon & Stiennon

(57) ABSTRACT

A doctor apparatus for a web forming machine to doctor a moving surface, and the doctor apparatus (10) includes a doctor blade (16) and blade holder (11), which blade holder (11) has a holder component (14) preferably made of aluminum, to which the doctor blade (16) is mounted by a front plate (15), and a frame component (12) preferably made of fiber-reinforced polymer material, to which the holder component (14) is mounted. The doctor apparatus (10) having a loading element (22) arranged between the frame component (12) and holder component (14) to load the blade holder (11) and further the doctor blade (16). The invention also relates to a corresponding blade holder and holder component.

19 Claims, 3 Drawing Sheets

DOCTOR APPARATUS AND BLADE HOLDER

CROSS REFERENCES TO RELATED APPLICATIONS

This application claims priority on Finnish Application No. FI 20145786, filed Sep. 9, 2014, the disclosure of which is incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The invention relates to a doctor apparatus for a web forming machine to doctor a moving surface, and the doctor apparatus includes a doctor blade and blade holder, which blade holder comprises:

a holder component to which the doctor blade is adapted, a frame component to which the holder component is adapted, in which doctor apparatus a loading element has been arranged between the frame component and holder component to load the blade holder and further the doctor blade.

The invention also relates to a corresponding blade holder and holder component.

At present, a doctor apparatus is known, for example, from publication FI 119823 (U.S. Pat. No. 8,152,966), where the frame component and holder component of the doctor apparatus are articulated with respect to each other and loaded by means of a resilient flexible element. In this structure, both the frame component and holder component are structures with the width of the web forming machine, manufactured from composite. However, it is considerably difficult and expensive to transport such solid structures more than 6 meters in width. When the length of the parts exceeds the normal standard dimension determined for container transport, the transport costs rise very high. Moreover, the durability of parts made from composite in wearing production conditions leaves much to hope for.

SUMMARY OF THE INVENTION

An object of the present invention is to accomplish a doctor apparatus which is more durable and more economical to transport than prior art doctor apparatuses. The characteristic features of the present invention wherein the holder component (14) is of aluminum and the frame component (12) is of fiber-reinforced polymer material wherein the holder component (14) is of aluminum. Another object of the present invention is to accomplish a holder component which is more durable and more economical to transport than prior art holder components. The characteristic features of the present invention is that the frame component (12) is of fiber-reinforced polymer material and the front plate (15) is of fiber-reinforced polymer material or spring steel. Yet another object of the present invention is to accomplish a blade holder which is more durable and more economical to transport than prior art blade holders.

This object can be accomplished by means of a doctor apparatus for a web forming machine to doctor a moving surface, which doctor apparatus includes a doctor blade and a blade holder, which blade holder comprises a holder component of aluminum, to which holder component the doctor blade is adapted, and a frame component, to which the holder component is adapted. In the doctor apparatus, a loading element has been arranged between the frame component and holder component to load the blade holder and further the doctor blade. A holder component manufactured from aluminum is more durable than a holder component manufactured from composite. It is surprising that a holder component of metal can be manufactured at a sufficiently low cost, with the manufacturing cost being even smaller than that of a holder component manufactured from composite.

The holder component is preferably a profiled aluminum section manufactured by extrusion. A profiled aluminum section manufactured by extrusion is much more inexpensive to manufacture than prior art composite parts manufactured by pultrusion.

The frame component is preferably made from composite. The term "composite" means here a fiber-reinforced polymer material. The polymer material can be epoxy, polyester, polyamide or polyethylene, typically and preferably epoxy. The fiber can be glass fiber, carbon fiber, aramid fiber, polyester fiber or polyamide fiber, typically glass fiber or carbon fiber. When the frame component and holder component are form-fitted with respect to each other and when they move with respect to each other, composite serves as a sacrificial material to aluminum, in which case jamming between the frame component and holder component can be prevented.

The holder component is preferably of anodized aluminum. Anodizing makes aluminum durable against hydrolysis and hence also durable in difficult operating conditions.

According to one embodiment, both the frame component and holder component are composed in the cross direction of the web forming machine of at least two parts in order to form a full-length doctor apparatus in sections. In this way, the frame component and holder component of the doctor apparatus can be transported in disassembled parts as normal cargo so that the transport costs are reduced to a fraction of the transport of special-dimension items.

Both the parts of the frame component and the parts of the holder component can include finger joint devices in order to assemble the frame component and holder component. By means of the finger joint devices, the parts can be locked to form a solid full-size frame component and holder component at the place of use of the doctor apparatus without separate fastening parts such as bolts or corresponding locking pieces or at least using fewer fastening parts.

The holder component can comprise both an upper jaw and lower jaw in order to fasten the doctor blade to the blade holder, or alternatively and more preferably the holder component can comprise only one jaw part (lower jaw), in which case the other jaw part (upper jaw) is separate, so-called front plate. The front plate can consist of two or more parts in order to form a full-sized doctor apparatus in sections. When disassembled into parts, the doctor apparatus can be transported preferably as normal cargo while the actual doctor blade is packed in a band-like form in a roll.

The mutual connection points of the frame component, holder component and front plate are preferably staggered with respect to each other so that the mutual connection points of the parts of the frame component are at a distance from the mutual connection points of the parts of both the holder component and front plate, and the mutual connection points of the parts of said holder component are at a distance from the mutual connection points of the parts of the front plate. In this case, the frame component, holder component and front plate support each other while the connections of the parts are staggered, when the connection points potentially weakening the longitudinal structure do not meet each other.

According to one embodiment, only one of the parts of the frame component, holder component and front plate has a varying length in order to determine the length of the doctor apparatus in the cross direction of the web forming machine, and the rest of the parts have standard lengths. A doctor apparatus with the desired length can be manufactured by means of standard-sized parts by changing the length of one part. This facilitates the manufacture of the parts of the doctor apparatus, because in this case standard-sized parts can be made in large series, which brings down the production costs.

The front plate can be made from composite or more preferably from spring steel. Spring steel is sufficiently durable and flexible for this purpose, enabling the yielding of the doctor blade when doctoring is performed.

The front plate comprises a first edge and a second edge in the longitudinal direction i.e., the machine direction, of the web forming machine, and an end surface corresponding to the second edge can be machined in the holder component. The end surface makes it possible to set the front plate directly to the blade holder, which, in turn, is important in view of the alignment of the doctor blade.

The front plate may have oval holes for fastening the doctor blade to the blade holder. The oval holes enable the thermal expansion of the holder component of the blade holder without the curling of the front plate. This is a requirement for the doctor blade of the doctor apparatus remaining in the correct position.

The doctor apparatus is preferably used for the cleaning of the surfaces of rotating rolls of a paper, board or tissue machine. In these applications, the operating conditions favor the use of aluminum.

The object of the blade holder according to the present invention can be accomplished by means of a holder component which forms a lower jaw supporting the blade and which comprises a loading element groove and which holder component is manufactured from aluminum. An aluminum holder component is very durable against hydrolysis, which extends the operating life of the blade holder.

The holder component is preferably divided into at least two parts in the cross direction of the web forming machine. A blade holder composed of parts is inexpensive to transport, because it can be carried as normal cargo.

The object of the blade holder according to the invention can be accomplished by means of a blade holder, which comprises a holder component of aluminum for the doctor blade, and a frame component to which the holder component has been adapted, and in which blade holder a loading element has been arranged between the frame component and holder component to load the blade holder and further the doctor blade.

More specifically, a characteristic feature of the doctor apparatus according to the invention is that the holder component of the blade holder is made from aluminum. More specifically, a characteristic feature of the holder component according to the invention is that the holder component is made from aluminum. More specifically, a characteristic feature of the blade holder according to the invention is that the holder component is made from aluminum.

The invention is described below in detail by making reference to the enclosed drawings that illustrate some embodiments of the invention.

DESCRIPTION OF THE PREFERRED EMBODIMENTS

Figure 1A:
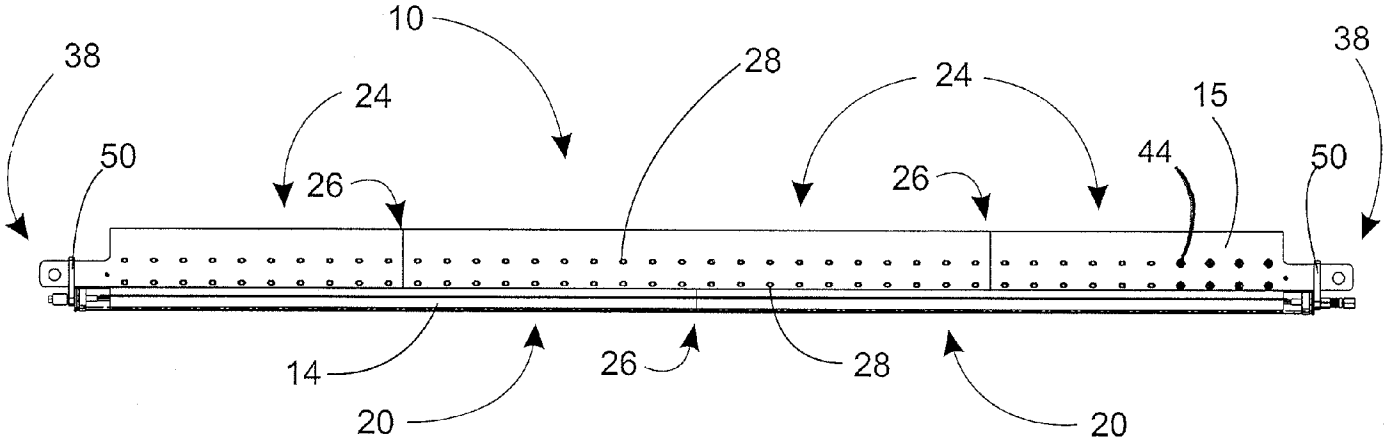
FIG. 1*a* shows the doctor apparatus according to the invention seen from above.
Figure 1B:
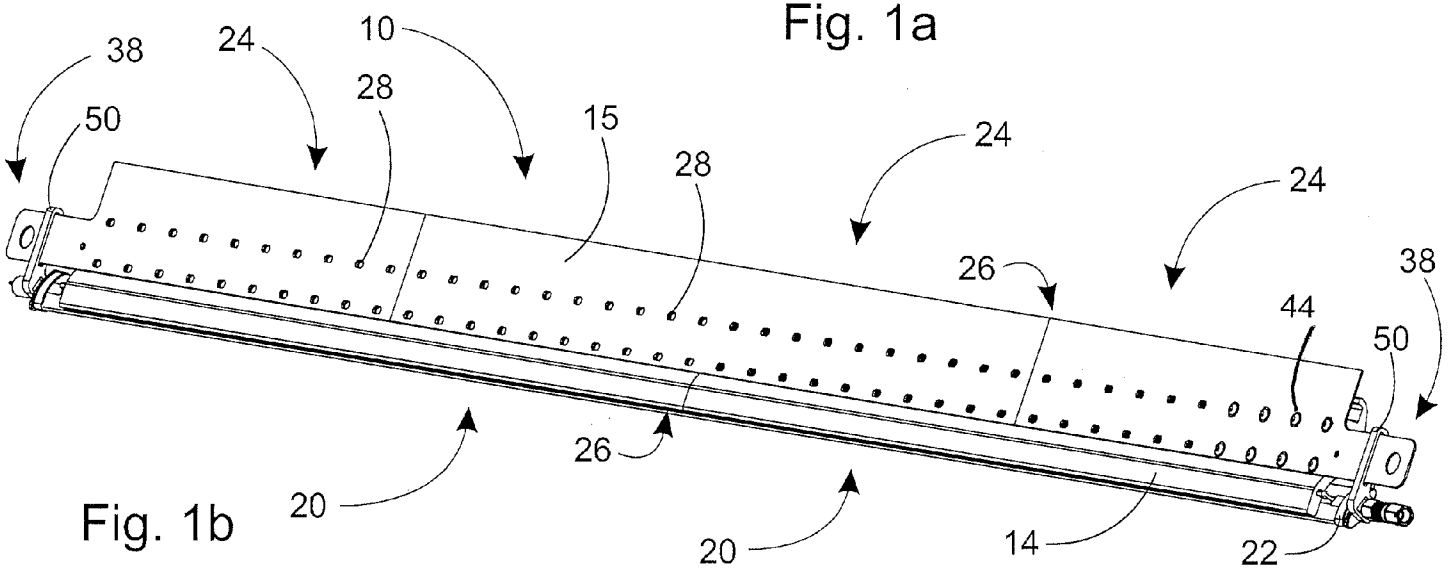
FIG. 1*b* shows the doctor apparatus according to the invention in an axonometric view without the doctor blade.
Figure 2:
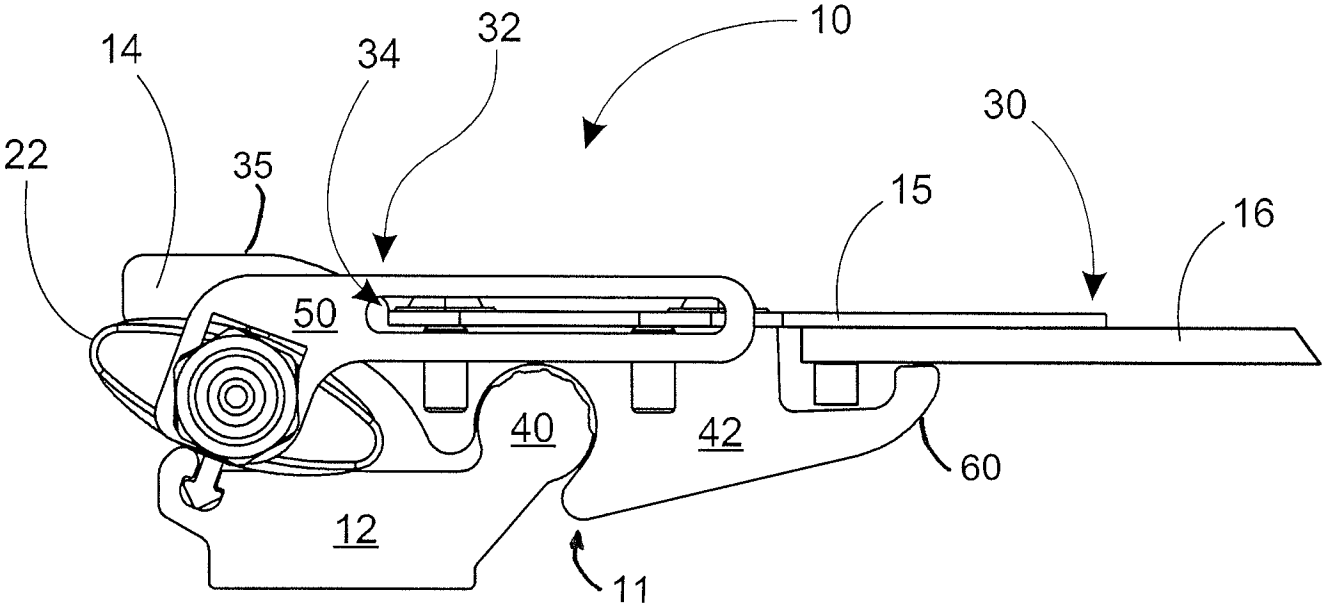
FIG. 2 shows the doctor apparatus according to the invention seen from an end.
Figure 3:
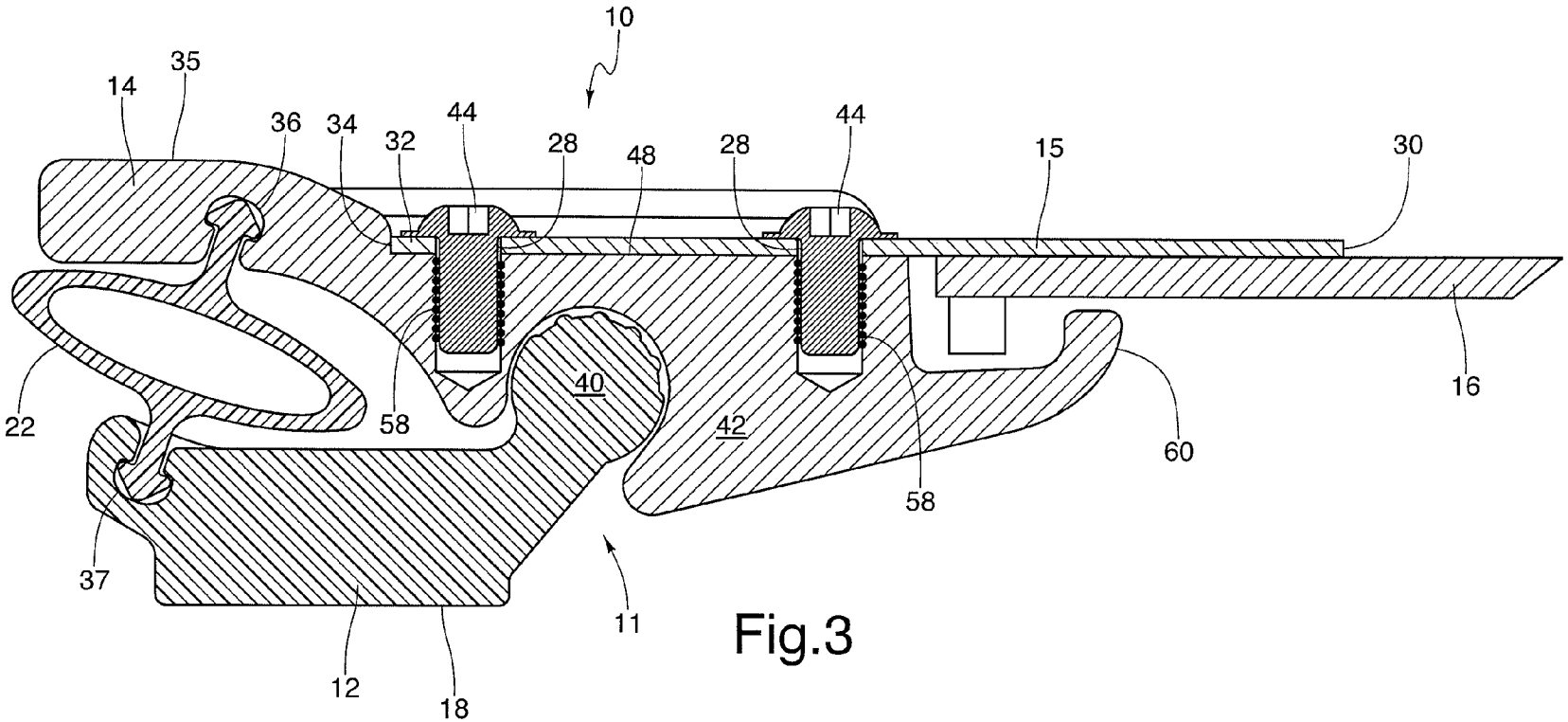
FIG. 3 shows the cross section of the doctor apparatus according to the invention.

FIGS. 1*a*-3 show one preferred embodiment of the doctor apparatus and blade holder according to the invention. The doctor apparatus is intended for a web forming machine to doctor a moving surface, and the doctor apparatus 10 includes a blade holder 11, which includes a frame component 12 and a holder component 14 adapted to the frame component 12, and a front plate 15 connected to the holder component 14, which holder component 14 and front plate 15 together form a pair of jaws, between which the doctor blade 16 (shown in FIG. 2) has been adapted. A loading element 22 has been arranged between the frame component 12 and holder component 14 to load the blade holder 11 and further the doctor blade 16, which loading element 22 enables the turning of the frame component 12 and holder component 14 with respect to each other by the effect of the loading. The frame component 12 and holder component 14 form a form-enclosed pair as shown in FIGS. 2 and 3, where the frame component 12 forms a male hinge piece 40 of the doctor apparatus 10 in the longitudinal direction, and the holder component 14 forms a female hinge piece 42 of the doctor apparatus 10 in the longitudinal direction. When the frame component 12 and holder component 14 turn with respect to each other by the effect of the loading element 22, the male hinge piece 40 and female hinge piece 42 serve as a fulcrum for the turning. The fulcrum is located at the middle section of the holder component 14, whereby the following are located on different sides of the fulcrum of the holder component 14 in the machine direction: a jaw part 60, which is formed by one end of the holder component 14, and the back part 35 of the holder component, which back part contains a groove 36 formed for the loading element 22. The doctor blade 16 is preferably fastened to the holder component 14 by means of the front plate 15. The jaw part 60 of the holder component 14 and the front plate 15 thus form a gap, to which the doctor blade 16 is supported. The form-enclosed articulated structure of the frame component 12 and holder component 14 enables the turning of the frame component 12 and holder component 14 with respect to each other, the fastening of the frame component 12 and holder component 14 to each other by means of a longitudinal movement of the doctor apparatus 10, and the cross-directional locking of the doctor apparatus between the frame component 12 and holder component 14. In this context, the longitudinal direction of the doctor apparatus means the cross direction of the web forming machine, and the cross direction of the doctor apparatus means the longitudinal direction of the web forming machine, in other words the machine direction. In accordance with FIG. 3, the holder component 14 has portions forming a cross machine direction loading element groove 36 to which groove the loading element 22 is connected. The frame component 12 has portion forming a cross machine direction loading element groove 37 to which loading element 22 is connected so that the holder component 14 and the frame component 12 are joined by the loading element 22.

In accordance with FIG. 3, the holder component 14 preferably forms on one of its surface a fastening plane 48, which serves as a fastening surface for the front plate 15 of the doctor apparatus 10. At the fastening plane 48 along the length of the blade holder 11, the holder component 14 can preferably include thread inserts 58 shown in FIG. 3, which thread inserts 58 serve as counter threads for the bolts or screws 44 used for fastening the front plate 15. The thread inserts can be of the type referred to as helicoil threads. Moreover, in accordance with FIG. 2, the blade holder 11 ends which form the longitudinal ends of the doctor apparatus 10 can include support elements 50, such as end plates, by means of which the front plate 15 is locked, in addition to the use of bolts or screws 44, to the blade holder 11. Moreover, the ends of the front plate 15 can include, in accordance with FIGS. 1*a* and 1*b*, extraction lugs 38 as extensions to the front plate 15, by means of which extraction lugs 38 the holder component 14 or the entire doctor apparatus can be pulled out from inside the web forming machine. Preferably for the bolts or screws, the front plate 15 includes oval holes 28, which enable the thermal expansion of the blade holder 14 without the curving effect of the front plate 15. The purpose of the front plate 15 is to support the doctor blade 16 and to serve, for its part, as an element enabling the flexibility of the doctor blade 16. FIGS. 1*a* and 1*b* only illustrates some of the bolts 44.

The holder component according to the invention used in a doctor apparatus according to the invention is manufactured from aluminum. A holder component manufactured from aluminum is considerably light in weight and durable. The holder component is preferably manufactured by extrusion, in other words by extruding molten aluminum from a nozzle to form a profiled aluminum section. An item manufactured by means of extrusion is considerably less expensive to manufacture than a composite item of the corresponding shape, manufactured by means of conventional pultrusion. This is so because an extrusion mold is considerably less expensive to manufacture than a corresponding pultrusion mold, and extrusion is also technically simpler to carry out than pultrusion. In this way, the manufacturing costs of a blade holder made from aluminum can be as much as 30% smaller than those of a corresponding item made from composite.

After the extrusion of the profiled aluminum section, a straight end surface 34 illustrated in FIGS. 2 and 3 is preferably machined in the profiled aluminum section, which end surface 34 serves as a surface guiding the front plate 15. The end surface can also be referred to as 0-surface or counter surface. The front plate 15 includes a first edge 30 on the side of the doctor blade 16 and its opposite edge on the side of the holder component, in other words a second edge 32. The front plate 15 settles against the end surface 34 of the holder component 14 by means of the second edge 32, whereby the end surface 34 also aligns the front plate 15 accurately and directly in the direction of the holder component 14. After machining, the holder component is preferably anodized to coat the blade holder. The anodized surface is durable and does not exhibit problems with hydrolysis. Moreover, aluminum can be used without rusting problems. The frame component 12 is preferably manufactured from composite in accordance with prior art. When the frame component 12 is made from composite and when the holder component 14 is made from aluminum, composite, being a weaker material, wears in a movement taking place against aluminum. Due to this, the frame component and holder component can move with respect to each other without the fear of the jamming of the items against each other. The frame component can also be made from aluminum, if the male hinge piece of the frame component is coated with a separate coating, which prevents the jamming of the frame component and holder component against each other.

Both the frame component 12 and holder component 14 can preferably be formed of at least two parts, in other words pieces, in the cross direction of the web forming machine. The parts of the frame component 12 are denoted with reference number 18, and the parts of the holder component 14 are denoted with reference number 20. In accordance with FIGS. 1*a* and 1*b*, the parts 18 and 20 divide both the frame component 12 and holder component 14 in the longitudinal direction of the doctor apparatus 10 (in other words in the cross direction of the web forming machine) into sections, which, when connected together, form a complete blade holder 11, in other words a complete frame component 12 and holder component 14. When manufactured from parts, both the frame component 12 and holder component 14 can be 1-2 m in length, in which case they can be transported as regular cargo. The front plate 15 can also be manufactured from parts 24 in accordance with FIGS. 1*a* and 1*b*.

The joints between the parts 18 and 20 in both the frame component 12 and holder component 14 respectively can be formed by using finger joint devices. In this case, the frame component 12 can be assembled to full length by connecting the parts 18 to each other by means of the form-enclosed finger joint devices, and the holder component 14 can also be assembled to full length by connecting the parts 20 to each other by means of the form-enclosed finger joint devices. By means of the finger joint devices, the locking between the parts can be carried out without separate locking pieces or screws and corresponding parts. The finger joint devices are preferably shaped so that the form-enclosed locking locks the pieces in the longitudinal direction of the frame component and holder component, in other words in the cross direction of the web forming machine, but enables the detaching of the pieces in the cross direction of the doctor apparatus, and more precisely in the vertical direction. The parts of the front plate can be manufactured without mutual locking devices, because the front plate is fastened to the blade holder in a stationary manner. The connections between the parts are preferably located so that the connection points 26 of the parts 18, 20 and 24 are staggered between the frame component 12, holder component 14 and front plate 15 in accordance with FIGS. 1*a* and 1*b*. This means that the finger joint devices of the parts of the frame component are at locations different from the locations of the finger joints of the parts of the holder component, and the connections of the parts of the front plate and also the finger joint devices of the parts of the holder component are at locations different from the locations of the connections of the parts of the front plate. In this way, the frame component, holder component and front plate assembled from the parts also serve as each other's locking pieces. Finger joint devices include in plane joints which lock two part together in the plane of the parts such as made with a CNC router or mill, or in plane dovetail joints or corresponding form-enclosed joints. Form-enclosed joints include joints like a dovetail joints or puzzle piece type joints which can be separated in the vertical direction but lock in the plane of the pieces.

If the frame component, holder component and front plate are formed of parts in sections, preferably only one of the parts of each of these is such that it is extruded individually on the basis of the length of the doctor apparatus. The rest of the parts can be of standard length, in which case these parts can be manufactured in larger series as they suit doctor apparatuses of all lengths. The length of an individual standardized part can be 1-2 m, in which case the length of the parts is suited to ordinary freight transport.

The doctor apparatus according to the invention can also be manufactured from a full-length frame component, holder component and front plate, but in this case it is more expensive to transport the parts. Moreover, in this case each doctor apparatus must be dimensioned individually, which means that it is more difficult to carry out serial production than in embodiments which utilize standard-length parts.

The doctor apparatus according to the invention can be used for the cleaning of the various moving surfaces of web forming machines. The doctor apparatus is preferably used for the cleaning of the surfaces of rotating rolls of a paper, board or tissue machine. The blade holder according to the invention can also be used together with existing doctor apparatuses to replace composite holder components, if the dimensions of the frame component of the blade holder are compatible with the holder component.

We claim:

1. A doctor apparatus, for a web forming machine to doctor a moving surface, comprises:

a doctor blade;

a blade holder, further comprising:

a holder component to which the doctor blade is mounted;

a frame component to which the holder component is pivotally mounted;

a loading element arranged between the frame component and the holder component to load the blade holder and the doctor blade mounted thereto; and wherein the holder component is of aluminum and the frame component is of fiber-reinforced polymer material;

wherein the holder component forms a first jaw of the blade holder; and further comprising a front plate mounted to the blade holder to form a second jaw of the blade holder, between which first jaw and second jaw the doctor blade is placed;

wherein the holder component has at least two parts which are held together by the front plate.

2. The doctor apparatus of claim 1 wherein the holder component is an extruded profiled aluminum section.

3. The doctor apparatus of claim 2 wherein the holder component has surfaces which are anodized.

4. The doctor apparatus of claim 1 wherein both said frame component and said holder component are each divided into at least two parts in a cross machine direction of the web forming machine which parts are joined to form the holder component and the frame component of the doctor apparatus.

5. The doctor apparatus of claim 4 wherein the parts of the frame component include finger joint devices which join the parts of the frame component and wherein the parts of the holder component include finger joint devices which join the parts of the holder component.

6. The doctor apparatus of claim 1 wherein each of the front plate, the frame component and the holder component are each divided into at least two parts in the cross machine direction of the web forming machine, each of the at least two parts being joined by a mutual connection point; and wherein the mutual connection points of the parts of the frame component, holder component and front plate are staggered in the cross machine direction with respect to each other.

7. The doctor apparatus of claim 6 wherein the frame component, the holder component, and the front plate are each formed of a plurality of parts no more than one of which is of a length in the cross-machine direction which differs from the others in each of the frame component, the holder component, and the front plate.

8. The doctor apparatus of claim 1 wherein the front plate has oval holes which are larger in the longitudinal direction of the doctor apparatus for fastening the front plate to the holder component.

9. The doctor apparatus of claim 1 wherein the front plate is of spring steel.

10. The doctor apparatus of claim 1 wherein the front plate comprises a first edge and a second edge in the machine direction of the web forming machine, and the second edge corresponds to an end surface that has been machined in the holder component.

11. The doctor apparatus of claim 1 wherein the frame component has portions forming one of a male hinge piece and a female hinge piece;

wherein the holder component has portions forming the other of the male hinge piece and the female hinge piece;

wherein the female hinge piece and the male hinge piece form a hinge, the hinge fastening the holder component to the frame component;

wherein the holder component includes a lower jaw part and a first groove connected to a loading element; and wherein the frame has a second groove connected to the loading element.

12. A holder component for holding a doctor blade which forms part of a doctor apparatus having a frame component having portions forming a male hinge piece and a first groove which is engaged to a loading member, the holder component comprising:

a lower jaw portion for supporting a doctor blade;

portions forming a second groove opposite the lower jaw for engaging the loading element;

portions forming a female hinge piece between the second groove and the lower jaw;

wherein the holder component is formed of aluminum; and further comprising a front plate mounted to the blade holder to form a second jaw of the blade holder between the first jaw and the second jaw a doctor blade is placed;

wherein the holder component has at least two parts which are held together by the front plate.

13. The holder component of claim 12 wherein the front plate is of fiber-reinforced polymer material or spring steel.

14. A doctor apparatus for a web forming machine to doctor a moving surface, the apparatus comprising:

a doctor blade;

a blade holder, further comprising:

a holder component to which the doctor blade is mounted;

a frame component to which the holder component is pivotally mounted;

a loading element arranged between the frame component and the holder component to load the blade holder and the doctor blade mounted thereto;

wherein the holder component is of aluminum and the frame component is of fiber-reinforced polymer material;

wherein both said frame component and said holder component are each divided into at least two parts in a cross machine direction of the web forming machine, which parts of the holder component are joined to form the holder component and which parts of the frame component are joined to form the frame component;

wherein the holder component forms a first jaw of the blade holder; and further comprising:

a front plate mounted to the blade holder to form a second jaw of the blade holder, between which first jaw and second jaw the doctor blade is placed; and wherein the front plate is divided into at least two parts in a cross machine direction of the web forming machine.

15. The doctor apparatus of claim 14 wherein the parts of the frame component include finger joint devices which join the parts of the frame component and wherein the parts of the holder component include finger joint devices which join the parts of the holder component.

16. The doctor apparatus of claim 14 wherein the parts of each of the front plate, the frame component and the holder component are joined by a mutual connection point; and wherein the mutual connection points of the parts of the frame component, holder component and front plate are staggered in the cross machine direction with respect to each other.

17. The doctor apparatus of claim 14 wherein the frame component, the holder component, and the front plate are each formed of a plurality of parts no more than one of which is of a length in the cross-machine direction which differs from the others in each of the frame component, the holder component, and the front plate.

18. A doctor apparatus for a web forming machine to hold a doctor blade for doctoring a moving surface, the apparatus comprising:

a holder component for mounting a doctor blade, the holder component having at least two parts arranged sequentially in a cross machine direction;

a frame component to which the holder component is pivotally mounted, the frame component having at least two parts arranged sequentially in the cross machine direction;

a loading element arranged between the frame component and the holder component to pivot the blade holder; and wherein the holder component is of aluminum and the frame component is of fiber-reinforced polymer material;

wherein the holder component forms a first jaw of the blade holder; and further comprising a front plate mounted to the blade holder to form a second jaw of the blade holder, between which first jaw and second jaw the doctor blade is placed;

wherein the front plate has at least two parts arranged sequentially in the cross machine direction, and wherein there are mutual connection points between the parts of each of: the frame component, the holder component and the front plate, which mutual connection points are staggered with respect to each other.

19. The doctor apparatus of claim 18 wherein the parts of the frame component include finger joint devices which join the parts of the frame component and wherein the parts of the holder component include finger joint devices which join the parts of the holder component; and wherein a plurality of fasteners hold the front plate to the holder component.

* * * * *